US007249991B1

(12) United States Patent
Watson

(10) Patent No.: US 7,249,991 B1
(45) Date of Patent: Jul. 31, 2007

(54) SAFE BALLOON NECK CLOSURE DEVICE AND METHOD

(76) Inventor: Jamie Watson, 3506 Park Point, Kingwood, TX (US) 77339

( * ) Notice: Subject to any disclaimer, the term of this patent is extended or adjusted under 35 U.S.C. 154(b) by 185 days.

(21) Appl. No.: 10/939,283

(22) Filed: Sep. 10, 2004

Related U.S. Application Data

(63) Continuation-in-part of application No. 29/189,099, filed on Aug. 28, 2003, now Pat. No. Des. 509,725.

(51) Int. Cl.
*A63H 3/06* (2006.01)
*B65D 77/10* (2006.01)

(52) U.S. Cl. ..... 446/220; 446/222; 24/30.5 S

(58) Field of Classification Search ..... 446/220–226; 24/30.5 S, 563
See application file for complete search history.

(56) References Cited

U.S. PATENT DOCUMENTS

| | | | | | |
|---|---|---|---|---|---|
| 1,680,318 | A | | 8/1928 | Callahan | |
| 2,396,906 | A | * | 3/1946 | Windson | 446/222 |
| 4,361,935 | A | * | 12/1982 | Paxton | 24/30.5 R |
| 4,509,231 | A | * | 4/1985 | Paxton | 24/30.5 R |
| 4,760,624 | A | * | 8/1988 | Fish | 24/30.5 S |
| D359,229 | S | * | 6/1995 | Jules | D8/395 |
| 5,799,377 | A | * | 9/1998 | Carroll et al. | 24/30.5 R |
| 6,007,403 | A | | 12/1999 | Urspringer et al. | |
| 6,238,259 | B1 | * | 5/2001 | Medina | 446/220 |
| 6,527,615 | B1 | * | 3/2003 | Boehler | 446/220 |
| 2003/0148701 | A1 | * | 8/2003 | Turjanmaa | 446/220 |
| 2004/0198146 | A1 | * | 10/2004 | Murray et al. | 446/220 |

OTHER PUBLICATIONS

Balloon Safetite Dics—Manufactured by Advertising Specialties, Inc., Ashland OH Webpage of S&S Worldwide (www.ssww.com).

* cited by examiner

*Primary Examiner*—Eugene Kim
*Assistant Examiner*—Urszula M Cegielnik
(74) *Attorney, Agent, or Firm*—Kenneth A. Roddy

(57) ABSTRACT

A soft flat balloon neck closure disc formed of non-rigid, soft, flexible, and resilient material for safe use with fluid filled balloons, including water filled balloons that may be thrown at a person. The device is relatively thick and has a flat top surface, a flat bottom surface, and a peripheral outer surface defining its shape. A first small hole and second small hole are each disposed inwardly from first and second segments of the peripheral outer surface in diametrically spaced apart relation and a first and second slit extend outwardly from the holes to the first and second side segments, respectively, and each has a V-shaped entrance. The first side segment is pushed onto the balloon neck such that the neck passes through the first slit and snaps into the first hole, the disc is slid down on the neck, and the neck is wrapped over the top of the disk, pulled inwardly through the second slit to snap into the second hole, and then back under the disc and upwardly through the first slit and hole.

4 Claims, 3 Drawing Sheets

SAFE BALLOON NECK CLOSURE DEVICE AND METHOD

CROSS REFERENCE TO RELATED APPLICATION

This is a continuation-in-part patent application of U.S. patent application Ser. No. 29/189,099, filed Aug. 28, 2003, now U.S. Pat. No. D.509,725, and priority thereof is claimed.

BACKGROUND OF THE INVENTION

1. Field of the Invention

This invention relates generally to balloon closures and methods for sealing the neck of a balloon, and more particularly to a balloon neck closure device and method utilizing a closure device formed of non-rigid, soft, flexible, resilient material that is safe to use with fluid filled balloons, including water filled balloons.

2. Background Art

Balloons filled with air or gases lighter than air are commonly used for party decorations, commercial promotions, and political rallies, as well as for toys. Water balloons are filled with water and are used for games and amusement by throwing or propelling them toward an object or a person so that they will burst upon impact and release the water.

A common problem with tying a large number of balloons for a birthday party, political rally or other such gathering, is that the resilient nature of the material from which the balloons are constructed is such that one's fingertips are constantly pinched and strained and will often become sore. In many instances, adults find that their fingers are too large to manipulate the necks of smaller balloons. In other instances, older persons may have arthritis or limited dexterity of the fingers that make tying a knot difficult. These problems are amplified in the case of tying a knot in a water balloon.

A water balloon is usually prepared by attaching the neck of a conventional balloon to a water faucet or hose with the water running inside the balloon until the balloon is filled with water. The user typically, twists the neck of the water-filled balloon and ties it into a knot. This is often difficult due to the heavy weight of the balloon and because the user's fingers and the portion of the neck to be held and tied by the user are wet and slippery, and the balloon will often slip and fall.

Balloon tying devices and methods are known in the art for sealing the neck of a balloon to prevent deflation. Many of these devices, known as "balloon ties" or "balloon closures" are made of plastic or other rigid or stiff material that can become a dangerous projectile should the balloon burst, and thus are not particularly safe for use with either gas filled or water filled balloons, and are particularly unsafe for use with a water balloon which may be thrown at a person.

A commercially available circular stiff plastic balloon tying disc known as the "E-Z Balloon Disc®" is marketed by Creative Balloons Manufacturing, Inc., of Pebble Beach, Calif., and is shown in U.S. Pat. Des. 359,229. This device is a flat circular disc made of stiff plastic material having a central hole at the center and a longer slot extending from the hole to the outer periphery, and three holes radially spaced from the center, each having a shorter slot extending radially outward from the respective hole to the outer periphery. A raised rim surrounds the circular periphery and central hole. This device could potentially become a dangerous projectile should the balloon burst, and is particularly unsafe for use with a water balloon which may be thrown at a person.

Another commercially available circular stiff plastic balloon tying disc is known as the "Balloon Safetite® Disc" is marketed by Specialty Advertising, Inc. This device is a flat circular disc made of stiff plastic material having a central hole at the center and a longer slot extending from the hole to the outer periphery, and a second hole diametrically spaced from the center having a shorter slot extending radially outward from the respective hole to the outer periphery. This device could also potentially become a dangerous projectile should the balloon burst, and is particularly unsafe for use with a water balloon which may be thrown at a person.

Callahan, U.S. Pat. No. 1,680,318 discloses a flat disk formed of a considerably stiff material, preferably punched from sheet fiber, having a hole in the center and slits extending inwardly from opposed edges. This device is used for connecting an elastic string to the balloon to for a "come-back" balloon. With this device, elastic string is wound through shorter slits and the balloon neck is installed upwardly through the center hole, the balloon is then inflated, and then the neck is twisted, wrapped over the top of the disk, drawn inwardly and downwardly through one slit, passed under the disk, and then drawn upwardly through the second slit. This device could also potentially become a dangerous projectile should the balloon burst, and is particularly unsafe for use with a water balloon which may be thrown at a person.

Windson, U.S. Pat. No. 2,396,906 discloses a flat disc formed of rigid or semi-rigid material, such as metal, wood, chip-board, or preferably plastic, having diametrically opposed arcuate side portions over the edges of which the neck of the balloon is to be wound, two neck receiving holes near each end, and a slot extending from one of the holes to the outer periphery of the disc. With this device, the balloon neck is installed upwardly through the first hole, the balloon is then inflated, and then the neck is wrapped over the top of the disc from side-to-side, pressed downwardly through the second slot into the second hole, and the mouth of the neck is disposed underneath the disc. This device could also potentially become a dangerous projectile should the balloon burst, and is particularly unsafe for use with a water balloon which may be thrown at a person.

Carroll et al, U.S. Pat. No. 5,799,377 discloses a flat closure disk formed of a polyurethane material having an upwardly extending nipple at the center and first, second, and third slots spaced about its perimeter. With this device, the neck of an inflated balloon is installed upwardly through the first slot, over the top of the disk, down through the second slot, and then upwardly through the third slot. The nipple is inserted into a centrally disposed opening of a retainer disk which is pressed down upon the closure disk. A decorative sheet of resilient material is disposed between the closure disk and retainer disk when the retainer disk is in placed on the closure disk, so that the material extends upwardly and outwardly from the closure disk and retainer disk in a decorative, generally conical shape. A tie is disposed about the sheet of material to gather the material together at a location just above the retainer disk. This assembly could also potentially become dangerous projectiles should the balloon burst, and would be particularly unsafe for use with a water balloon which may be thrown at a person.

Urspringer, U.S. Pat. No. 6,007,403 discloses a flat circular disc formed of a resilient material having a single normally closed slit at the center. The disc is squeezed from the sides to widen the slit, the neck of a balloon is installed upwardly through the widened slit and twisted, and then the disk is released to allow the slit to retract and grip the twisted neck of the balloon. This device relies merely on the resiliency of the disc material to contract the slit and grip the twisted neck and frictional contact with the rubber balloon material for affecting a seal, rather than wrapping the neck around the device. This device also requires a great deal of manual dexterity in poking the twisted balloon neck through the slit in the center of the disc and would be time-consuming, cumbersome, and difficult to install on fluid filled balloons, particularly a heavy slippery water balloon wherein the disc material and rubber balloon material are typically wet.

The present invention is distinguished over the prior art in general, and these patents in particular by a soft flat balloon neck closure disc formed of non-rigid, soft, flexible, and resilient material that is safe use with fluid filled balloons, including water filled balloons that may be thrown at a person. The device is relatively thick and has a flat top surface, a flat bottom surface, and a peripheral outer surface defining its shape. A first small hole and second small hole are each disposed inwardly from first and second segments of the outer surface in diametrically spaced apart relation and a first and second slit extend outwardly from the holes to the first and second side segments, respectively, and each has a V-shaped entrance.

In another aspect of the present invention a method for sealing the neck of a fluid filled balloon includes the steps of providing the closure device as described and pushing the first side segment onto the balloon neck such that the neck passes through the first slit and snaps into the first hole, sliding the disc down on the neck, and wrapping the neck over the top of the disc, pulling it inwardly through the second slit to snap into the second hole, and then back under the disc and upwardly through the first slit and hole.

SUMMARY OF THE INVENTION

It is therefore an object of the present invention to provide a safe non-rigid, soft, flexible, and resilient balloon neck closure device that will significantly reduce injuries caused by conventional rigid balloon neck closure devices that can become dangerous projectiles should the balloon burst, and is particularly safe for use with a water balloon which may be thrown at a person.

It is another object of this invention to provide a balloon neck closure device and method utilizing a closure device formed of non-rigid, soft, flexible, resilient and lightweight material that is safe to use with fluid filled balloons, including water filled balloons.

Another object of this invention is to provide a safe non-rigid, soft, flexible, and resilient balloon neck closure device and method that permits a person to expeditiously tie off a fluid filled balloon, including a slipper water balloon.

Another object of this invention is to provide a safe non-rigid, soft, flexible, and resilient balloon neck closure device and method that can effectively seal water filled balloons as well as balloons filled with air and gases lighter than air.

Another object of this invention is to provide a safe balloon neck closure device and method which does not require a great deal of manual dexterity to close off a water filled or gas filled balloon.

A further object of this invention is to provide a safe balloon neck closure device that may be produced in a wide variety of aesthetic and ornamental shapes and colors.

A still further object of this invention is to provide a safe balloon neck closure device that is inexpensive to manufacture and reusable.

Other objects of the invention will become apparent from time to time throughout the specification and claims as hereinafter related.

The above noted objects and other objects of the invention are accomplished by a soft flat balloon neck closure disc formed of non-rigid, soft, flexible, and resilient material that is safe use with fluid filled balloons, including water filled balloons that may be thrown at a person. The device is relatively thick and has a flat top surface, a flat bottom surface, and a peripheral outer surface defining its shape. A first small hole and second small hole are each disposed inwardly from first and second segments of the outer surface in diametrically spaced apart relation and a first and second slit extend outwardly from the holes to the first and second side segments, respectively, and each has a V-shaped entrance.

In another aspect of the present invention a method for sealing the neck of a fluid filled balloon includes the steps of providing the closure device as described and pushing the first side segment onto the balloon neck such that the neck passes through the first slit and snaps into the first hole, sliding the disc down on the neck, and wrapping the neck over the top of the disc, pulling it inwardly through the second slit to snap into the second hole, and then back under the disc and upwardly through the first slit and hole.

DESCRIPTION OF PREFERRED EMBODIMENTS

Figure 1:
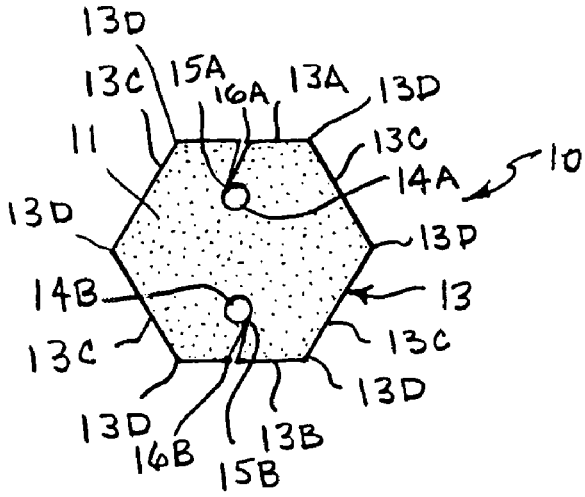
FIG. 1 is a top plan view of a balloon closure device in accordance with the present invention.
Figure 2:
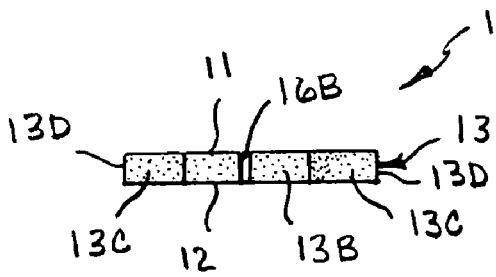
FIG. 2 is a side elevation view of the balloon closure device.
Figure 3:
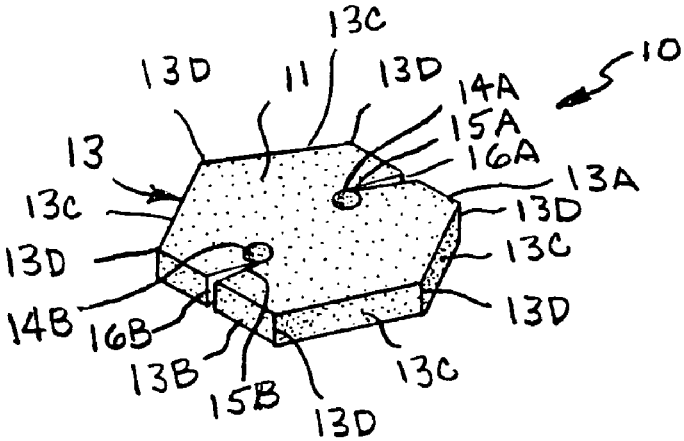
FIG. 3 is an isometric view of the balloon closure device.

Referring to the drawings by numerals of reference, there is shown in FIGS. 1, 2 and 3, a preferred balloon closure device 10. The device 10 is a flat disc-shaped unitary body formed of a non-rigid, soft, flexible and resilient material such as, but not limited to, cellular polyurethane or polyethylene based foam material, or other suitable soft resilient rubber, latex or elastomeric material. The device 10 has a flat top surface 11, a flat bottom surface 12, and a peripheral outer surface 13 circumscribing the top and bottom surfaces and defining the shape of the device. In the embodiment of FIGS. 1–3, the peripheral outer surface 13 is in the shape of a hexagon having a first straight side segment 13A and a second straight side segment 13B parallel thereto adjoined by four angular side segments 13C forming diametrically opposed corners 13D.

A first small hole 14A and a second small hole 14B are formed through the device 10 a short distance inwardly from the first side segment 13A and the second side segment 13B, respectively, in diametrically spaced apart relation. In a preferred embodiment, the holes 14A and 14B are about 3/32" in diameter, but can vary. A first slit 15A and a second slit 15B formed through the device 10 extend outwardly from the first hole 14A and second hole 14B to the first side segment 13A and second side segment 13B of the peripheral outer surface 13, respectively. The opposed side surfaces of each slit 15A and 15B at its juncture with the respective hole 14A and 14B are biased normally closed by the resiliency of the material and diverge or flare slightly apart at their outer end to provide respective V-shaped entrances 16A and 16B on the first side segment 13A and second side segment 13B of the peripheral outer surface 13, to facilitate insertion of the device 10 onto the neck of the balloon, and vise versa. The normally closed portion of each slit facilitates retaining the neck in the respective hole.

The thickness of the device 10 is preferably about 5/32" and, in the hexagonal embodiment, the distance between the diametrically opposed corners is about ¾". As described hereinafter, the overall dimensions of the device and the configuration of the peripheral outer surface 13 can vary to provide closure devices of different aesthetic and ornamental shapes.

Installation Method for Water Balloons

Referring now to FIGS. 4A–4D, as well known in the art, the typical balloon 17 has a body 18 and a contiguous neck 19 extending therefrom with an annular ring 20 at its outer end. A water balloon is typically prepared by attaching the neck of the balloon to a water faucet or hose and allowing the water to fill the balloon with the desired volume of water.

The user grips the outer end of the neck 19 of the filled balloon 17 with the thumb and forefinger of one hand and, in the case of a water balloon, gravity acting on the heavier body 18 of the balloon exerts a downward force and the neck assumes a generally vertical orientation and becomes elongated or stretched. The neck 19 of the balloon also becomes constricted or narrower as it is elongated or stretched.

Figure 4A:
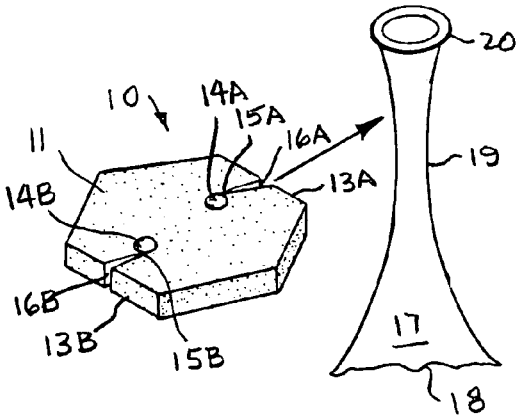
FIGS. 4A through 4D are isometric views illustrating the method installing the device on the neck of a balloon in accordance with the present invention.
Figure 4B:
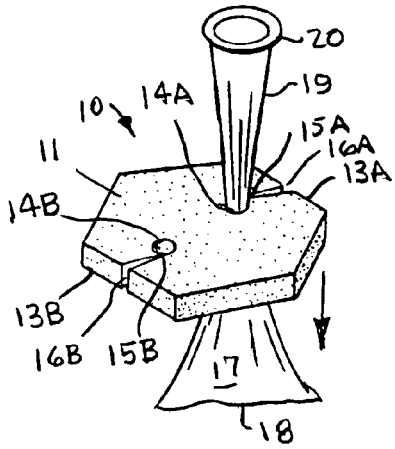
Figure 4C:
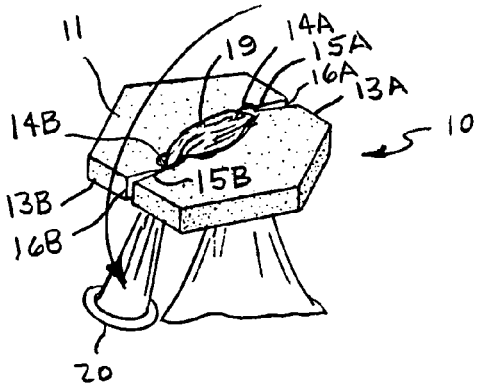

The user grips the closure device 10 with the thumb and forefinger of the other hand and orients it generally perpendicular to the neck of the balloon and pushes the entrance 16A of the first slit 15A on the first side segment 13A of the device onto the neck 19 of the balloon 17 until the neck passes through the slit and snaps into the first hole 14A (FIG. 4A). The user then slides the device 10 downward on the neck of the balloon about 1½" to 2" from the ring 20 at the top of the neck (FIG. 4B).

Figure 4D:
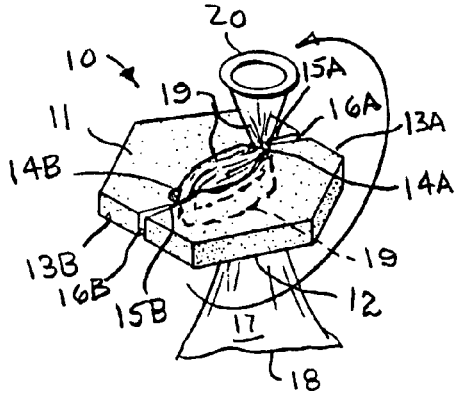
Figure 4E:
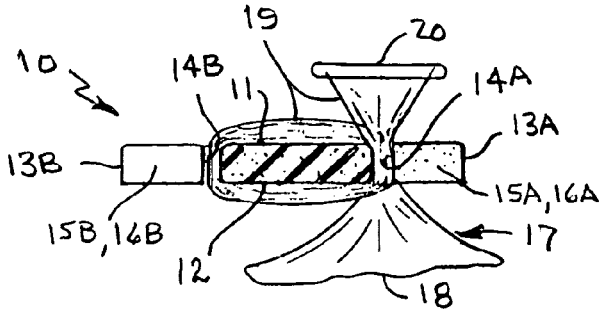
FIG. 4E is an enlarged cross sectional view of the device showing the neck of the balloon in a sealing condition following in accordance with the present invention.

While still gripping the device 10, and using the hand holding the neck 19 of the balloon 17, the user wraps the upper portion of the neck over the top surface 11 of the device 10 and pulls it into the entrance 16B of the second slit 15B on the opposed second side segment 13B of the device until the neck passes through the slit and snaps into the second hole 14B (FIG. 4C), wraps it under the bottom surface 12 of the device, and pulls it back into the entrance 16A of the first slit 15A on the first side segment 13A until the neck again passes through the slit and snaps into the first hole 14A, thereby completing the installation (FIGS. 4D and 4E).

Installation Method for Inflated Balloons

The present closure device 10 can also be installed on balloons that are filled with air or a gas lighter than air, such as helium. The steps are essentially the same as described with reference to FIGS. 4A–4E, and will not be repeated again to avoid repetition, except in the case of an air filled or helium filled balloon, the user may first twist the neck 19 of the balloon 17 to prevent the air or gas from escaping, and the lighter gas-filled body 18 of the balloon is held stationary by any suitable means, such as between the elbow and side of the user's body, between the knees, or held by another person, and because the weight of the body is much lighter, the neck need not be oriented vertically and may be manually stretched outwardly relative to the balloon body.

Referring again to FIG. 1, in the hexagonal embodiment of the device 10, the diametrically opposed corner portions, which are disposed outwardly a distance from a central axis extending through the holes 14A and 14B, provide lateral gripping areas on the top and bottom surfaces 11 and 12 to receive the user's thumb and forefinger for holding and manipulating the device during the attachment and wrapping steps and facilitate wrapping the neck without it being obstructed by the fingers of the user.

As discussed above, the overall dimensions of the device and the configuration of the peripheral outer surface 13 can vary to provide closure devices of different aesthetic and ornamental shapes, and shapes resembling various objects. The following examples are a few of the possible regular or irregular, symmetrical or non-symmetrical shapes.

In the following discussion, the elements which are the same or substantially similar to those previously described are assigned the same numerals of reference, but will not be described again in detail to avoid repetition.

Figure 5A:
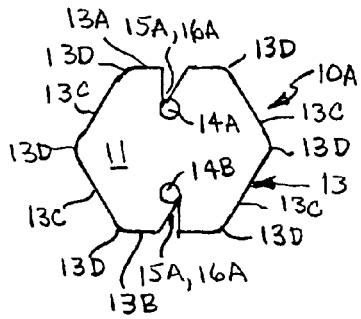
FIGS. 5A through 5J are top plan views of the balloon closure device having various alternate shaped configurations.
Figure 5B:
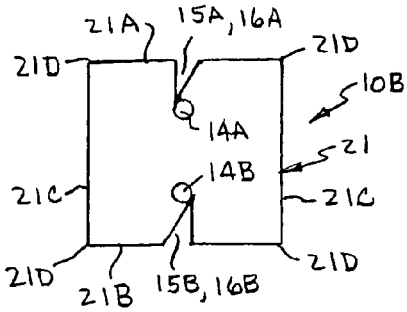

FIG. 5A shows a modification of the device 10A with a peripheral outer surface 13 having a generally hexagonal shape similar to the embodiment of FIGS. 1–3, wherein the corners 13D are rounded. FIG. 5B shows a rectangular device 10B wherein the peripheral outer surface 21 has diametrically opposed first and second straight side segments 21A and 21B adjoined to two opposed straight lateral straight side segments 21C at four corners 21D.

Figure 5C:
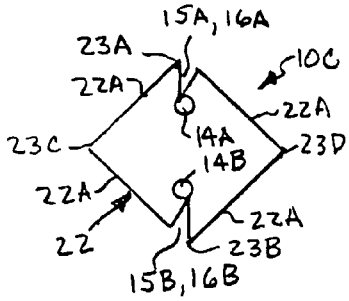

FIG. 5C shows another four-sided rectangular device 10C in the shape of a diamond, wherein the peripheral outer surface 22 has four opposed straight side segments 22A and four diametrically opposed corner segments 23A, 23B, 23C and 23D. In this embodiment, the small holes 14A and 14B are formed through the device 10 a short distance inwardly from a first corner 23A and a second diametrically opposed corner 23B, respectively, in diametrically spaced apart relation, and the first and second slits 15A and 15B with their V-shaped entrances 16A and 16B extend outwardly from the holes to the corners 23A and 23B, respectively. Thus, the corner 23A defines the first segment of the peripheral outer surface, and the second corner 23B disposed in diametrically opposed relation thereto defines the second segment of the peripheral outer surface.

Figure 5D:
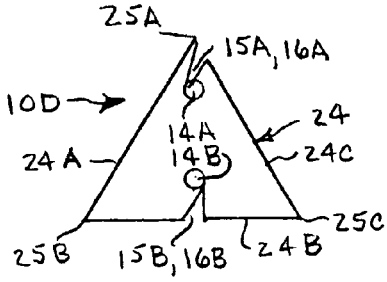

FIG. 5D shows a triangular device 10D, wherein the peripheral outer surface 24 has three straight side segment 24A, 24B and 24C adjoined by three corner segments 25A, 25B and 25C. The corner 25A forming the apex of the triangular shape defines the first segment of the peripheral outer surface, and the base side segment 24B, disposed in diametrically opposed relation thereto, defines the second segment of the peripheral outer surface. In this embodiment, the first small hole 14A is disposed a short distance inwardly from the apex or first corner 23A, the second small hole 14B is disposed a short distance inwardly from the base side segment 24B, respectively, in diametrically spaced apart relation, and the first and second slits 15A and 15B with their V-shaped entrances 16A and 16B extend outwardly from the holes to the corner segment 23A and base side segment 24B, respectively.

It should be understood that the peripheral outer surface of the present device may be configured to provide other polygonal shapes, such as a pentagon, or octagon.

Figure 5E:
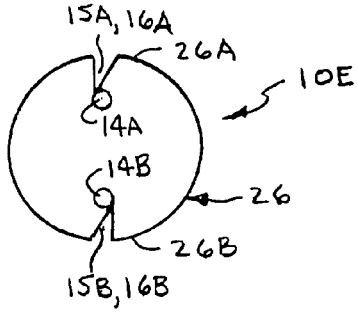

FIG. 5E shows a circular device 10E, wherein the peripheral outer surface 26 is a circular configuration. In this embodiment, the first small hole 14A and the second small hole 14B are each disposed a short distance inwardly from diametrically opposed segments 26A and 26B of the peripheral outer surface 26 in diametrically opposed spaced apart relation, and the first and second slits 15A and 15B with their V-shaped entrances 16A and 16B extend outwardly from the holes to the segments 26A and 26B of the peripheral outer surface 26 in diametrically opposed relation. It should be understood that a substantially similar devices may be provided with an oval or elliptical shape.

Figure 5F:
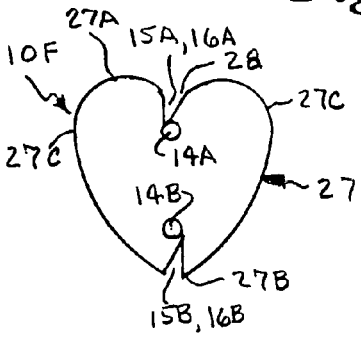

FIG. 5F shows a device 10F, wherein the peripheral outer surface 27 is in the shape of a heart, having a V-shaped notch 28 in a first segment 27A (top side as seen in the figure) and opposed outwardly rounded segments on each side of the notch that converge downwardly to a pointed end 27B (bottom side as seen in the figure) disposed in diametrically opposed relation to the notch and forming the second segment the peripheral outer surface. In this embodiment, the first small hole 14A is disposed a short distance inwardly from the V-shaped notch 28, the second small hole 14B is disposed a short distance inwardly from the pointed end 27B, respectively, in diametrically spaced apart relation, and the first and second slits 15A and 15B with their V-shaped entrances 16A and 16B extend outwardly from the holes to the V-shaped notch 28 and pointed end 27B, respectively.

Figure 5G:
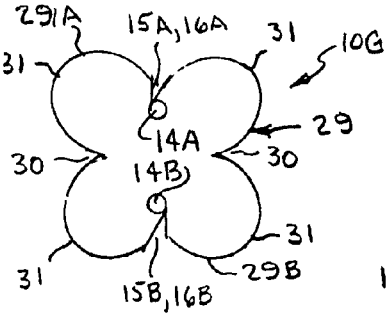

FIG. 5G shows a device 10G, wherein the peripheral outer surface 29 is in the shape of a butterfly. The first and second small holes 14A and 14B are disposed a short distance inwardly from the first side segment 29A (top side as seen in the figure) and second side segment 29B (bottom side as seen in the figure), respectively, in diametrically spaced apart relation, with the first and second slits 15A and 15B and their V-shaped entrances 16A and 16B extending outwardly from the holes. In this embodiment, a V-shaped notch 30 is provided at each opposed lateral side segment, and outwardly rounded segments 31 on each side of the V-shaped entrances 16A and V-shaped notches 30 adjoin the V-shaped entrances and notches.

Figure 5H:
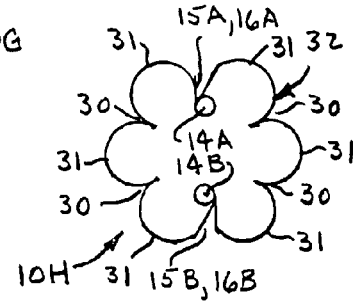
Figure 5I:
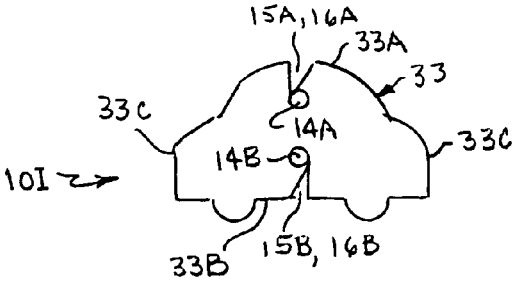

FIG. 5H shows a device 10H, wherein the peripheral outer surface 32 is in the shape of a flower, which is similar to the embodiment of FIG. 5G except that there are a pair of V-shaped notches 30 at each of the opposed lateral side segments, and the V-shaped entrances 16A and 16B and V-shaped notches 30 are adjoined by outwardly rounded segments on each side of the V-shaped entrances and notches.

As previously stated, the present closure device may also be provided in shapes resembling various objects. FIG. 51 shows a device 101, wherein the peripheral outer surface 33 is in the shape of a vehicle, such as an automobile. In this embodiment, the first side segment 33A (top side as seen in the figure) is contoured outwardly to resemble the top or upper portion of the automobile, and the opposed second side segment 33B (bottom side as seen in the figure), is shaped to resemble the bottom or lower portion of the automobile. The first and second small holes 14A and 14B are disposed a short distance inwardly from the first side segment 33A (top side as seen in the figure) and second side segment 33B (bottom side as seen in the figure), respectively, in diametrically spaced apart relation, with the first and second slits 15A and 15B and their V-shaped entrances 16A and 16B extending outwardly from the holes. The V-shaped entrances 16A and 16B are adjoined to opposed lateral side segments 33C and 33D, which are configured to resemble the front and back portion of the automobile, respectively. It should be understood that the peripheral outer surface may be configured to resemble other vehicle shapes.

Figure 5J:
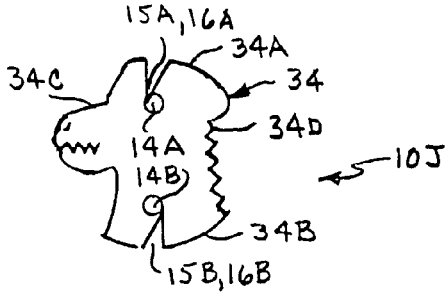

FIG. 5J shows a device 10J, wherein the peripheral outer surface 34 is in the shape of a portion of an animal, such as the head of a dinosaur. In this embodiment, the first side segment 34A (top side as seen in the figure) is contoured outwardly to resemble the top portion or head of the animal, and the opposed second side segment 34B (bottom side as seen in the figure), is shaped to resemble the neck portion of the animal. The first and second small holes 14A and 14B are disposed a short distance inwardly from the first side segment 34A (top side as seen in the figure) and second side segment 34B (bottom side as seen in the figure), respectively, in diametrically spaced apart relation, with the first and second slits 15A and 15B and their V-shaped entrances 16A and 16B extending outwardly from the holes. The V-shaped entrances 16A and 16B are adjoined to opposed lateral side segments 34C and 34D, which are configured to resemble the nose or face and back of the head portions of the animal, respectively.

The above represent some of the typical shapes that may be incorporated into the present closure device, but not limited thereto, and it should be understood that the present device may be produced in various other regular or irregular, symmetrical or non-symmetrical shapes and shapes resembling various objects, without departing from the scope of the invention.

While this invention has been described fully and completely with special emphasis upon preferred embodiments, it should be understood that within the scope of the appended claims the invention may be practiced otherwise than as specifically described herein.

The invention claimed is:

1. A balloon neck closure device for manually sealing the neck of a liquid or gas filled balloon having an integrally formed neck and body, comprising:

a relatively thick closure disc formed of non-rigid, soft, flexible, resilient material having a flat top surface, a flat bottom surface, and a peripheral outer surface defining a shape having a first side segment and a second side segment disposed in diametrically opposed spaced apart relation;

a first small hole and second small hole each disposed inwardly from said first side segment and said second side segment, respectively, in diametrically spaced apart relation;

a first slit and a second slit extending outwardly from said first small hole and said second small hole to said first and second side segments of said outer surface, respectively, each said slit having opposed side surfaces at its juncture with said respective first and second hole that are biased normally closed by the resiliency of the disc material and diverge slightly apart at their outer end to define a respective first and second V-shaped entrance; wherein said disc is held manually and said first side segment is pushed laterally onto a stretched balloon neck such that the neck is received in said first slit V-shaped entrance, passes through said first slit and snaps into said first hole, said disc is slid down on the neck, and the neck is wrapped over said disc top surface, pulled inwardly through said second slit V-shaped entrance and said second slit to snap into said second hole, and then under said disc and inwardly back through said first slit V-shaped entrance and said first slit to snap into said first hole to extend outwardly from said top surface, thereby sealing the balloon neck.

2. The balloon neck closure device according to claim 1, wherein said disc is formed of a non-rigid, soft, flexible and resilient material selected from the group consisting of cellular polyurethane based foam, cellular polyethylene based foam, soft resilient rubber, latex, and elastomeric materials.

3. The balloon neck closure device according to claim 1, wherein said peripheral outer surface is configured to provide said disc with a shape selected from the group consisting of polygonal shapes, regular, irregular, symmetrical, and non-symmetrical shapes, and shapes generally resembling animals and objects, said shapes characterized by having said first and second segments disposed in diametrically spaced apart relation.

4. A balloon neck closure device for manually sealing the neck of a liquid or gas filled balloon having an integrally formed neck and body, comprising:

a relatively thick closure disc formed of non-rigid, soft, flexible, resilient material having a flat top surface, a flat bottom surface, and a peripheral outer surface configured in the shape of a hexagon having a first straight side and a second straight side parallel thereto disposed in diametrically opposed relation, and four angular sides adjoined thereto forming diametrically opposed corners;

a first small hole and second small hole each disposed inwardly from said first straight side and said second straight side, respectively, in diametrically spaced apart relation;

a first slit and a second slit extending outwardly from said first small hole and said second small hole to said first straight side and said second straight side, respectively, each said slit having opposed side surfaces at its juncture with said respective first and second hole that are biased normally closed by the resiliency of the disc material and diverge slightly apart at their outer end to define a first and a second V-shaped entrance on said first straight side and said second straight side, respectively; wherein said disc is held manually and said first straight side is pushed laterally onto a stretched balloon neck such that the neck is received in said first slit V-shaped entrance, passes through said first slit and snaps into said first hole, said disc is slid down on the neck, and the neck is wrapped over said disc top surface, pulled inwardly through said second slit V-shaped entrance and said second slit to snap into said second hole, and then under said disc and inwardly back through said first slit V-shaped entrance and said first slit to snap into said first hole to extend outwardly from said top surface, thereby sealing the balloon neck.

* * * * *